US008036066B2

(12) United States Patent
Schlencker et al.

(10) Patent No.: US 8,036,066 B2
(45) Date of Patent: Oct. 11, 2011

(54) WATCH

(75) Inventors: Christoph Schlencker, Hirschbach (DE); Helmut Geyer, Glashuette (DE)

(73) Assignee: Lange Uhren GmbH, Glashuette (DE)

( * ) Notice: Subject to any disclaimer, the term of this patent is extended or adjusted under 35 U.S.C. 154(b) by 554 days.

(21) Appl. No.: 11/666,385

(22) PCT Filed: Mar. 2, 2006

(86) PCT No.: PCT/EP2006/001891

§ 371 (c)(1),
(2), (4) Date: Sep. 8, 2008

(87) PCT Pub. No.: WO2006/094698

PCT Pub. Date: Sep. 14, 2006

(65) Prior Publication Data

US 2009/0016174 A1 Jan. 15, 2009

(30) Foreign Application Priority Data

Mar. 6, 2005 (DE) ..... 10 2005 010 604

(51) Int. Cl.
*G04B 19/22* (2006.01)

(52) U.S. Cl. ..... 368/22; 368/21

(58) Field of Classification Search ..... 368/21, 368/22–27

See application file for complete search history.

(56) References Cited

U.S. PATENT DOCUMENTS

| | | | | |
|---|---|---|---|---|
| 2,641,898 | A | 6/1953 | Galley | |
| 3,599,421 | A * | 8/1971 | Walker | 368/21 |
| 3,693,344 | A * | 9/1972 | Cleusix | 368/22 |
| 3,695,035 | A * | 10/1972 | Cleusix | 368/22 |
| 3,745,762 | A * | 7/1973 | Kocher et al. | 368/185 |
| 4,945,521 | A | 7/1990 | Klaus | |
| 5,075,231 | A | 12/1991 | Moreau et al. | |
| 6,335,773 | B1 | 1/2002 | Kamei et al. | |
| 6,597,635 | B2 * | 7/2003 | Dalloz | 368/21 |
| 6,918,694 | B2 * | 7/2005 | Speichinger et al. | 368/190 |
| 6,935,773 | B2 | 8/2005 | Speichinger et al. | |
| 7,639,568 | B2 * | 12/2009 | Lin | 368/22 |

(Continued)

FOREIGN PATENT DOCUMENTS

CH 10 812/66 4/1968

(Continued)

OTHER PUBLICATIONS

Search Report dated Dec. 21, 2006 for the underlying International Application No. PCT/EP2006/001891.

*Primary Examiner* — Sean Kayes
(74) *Attorney, Agent, or Firm* — Cozen O'Connor

(57) ABSTRACT

The invention relates to a watch comprising a first hour wheel (16) which is rotatably driven around a rotating pin (3) by means of a drive unit and supports a first hour hand (1), and a second hour wheel ((26) that is joined to the first hour wheel (16) via a springy catching connection and is rotatably driven about a second rotating pin (13) by the first hour wheel (16), a second hour hand (11) being rotatably driven by means of said second hour wheel (26). The watch further comprises a manually adjustable winding stem (62) which supports a drive wheel and with the aid of which the two hour wheels (16 and 23) can be adjusted jointly or individually. The first hour wheel (16) can be adjusted by the drive wheel while the second hour wheel or a third hour tube (26) that supports the second hour hand (11) can be blocked by a manually actuated blocking device.

20 Claims, 5 Drawing Sheets

U.S. PATENT DOCUMENTS

| | | | |
|---|---|---|---|
| 2003/0151984 | A1 | 8/2003 | Speichinger et al. |
| 2006/0285443 | A1 | 12/2006 | Vogt et al. |

FOREIGN PATENT DOCUMENTS

| | | | |
|---|---|---|---|
| DE | 38 32 514 | | 11/1989 |
| EP | 1 336 907 | | 8/2003 |
| JP | 63079589 | | 4/1988 |
| JP | 63-79589 | U | 5/1988 |
| JP | 2116782 | | 5/1990 |
| JP | 2003248066 | A | 9/2003 |
| WO | WO 2004/053599 | | 6/2004 |

* cited by examiner

WATCH

CROSS-REFERENCE TO RELATED APPLICATIONS

This is a U.S. national stage of International Application No. PCT/EP2006/001891, filed on 02 Mar. 2006. Priority is claimed on German Application No. 10 2005 010 604.8, filed on 06 Mar. 2005.

BACKGROUND OF THE INVENTION

1. Field of the Invention

The invention pertains to a watch with a first hour wheel, which carries a first hour hand and can be rotated around an axis of rotation by a drive; with a second hour wheel, which can rotate a second hour hand, is connected to the first hour wheel by a spring-loaded latching connection, and can be rotated around a second axis of rotation by the first hour wheel; with a manually rotatable adjusting stem, which carries a drive wheel and by means of which both of the hour wheels can be adjusted jointly or one of them can be adjusted individually.

2. Description of the Related Art

So that, in a watch of this type, the first hour hand can be adjusted to the same position as the second hour hand, an adjusting device which is independent of the time zone ring is required for the second hour hand. For this purpose, a third position of the adjusting stem can be used, where the first position is used to wind up the watch, the second position is used to adjust the hands jointly, and the third is used to adjust the second hour hand independently of the time zone ring.

Because of the short distances by which the adjusting stem is moved, the stem can easily assume the wrong position, which leads in turn to an unwanted adjustment of the watch. In addition, a time zone mechanism cannot be integrated into a basic watch movement in which the adjusting stem has only two positions.

SUMMARY OF THE INVENTION

The task of the invention is therefore to create a watch of the type indicated above which is simple in design but which nevertheless makes it possible to adjust the first hour hand individually.

This task is accomplished according to the invention in that the first hour wheel can be adjusted by the drive wheel, and in that the second hour wheel or a third hour tube carrying the second hour hand can be blocked by a manually actuatable blocking device.

It is obvious that the first hour wheel does not have to drive the second hour wheel or a third hour tube carrying the second hour hand directly. It is also possible, for example, for both hour wheels to be driven jointly by a common drive train for the minute wheels of the two time displays.

As a result of the inventive solution, the first hour hand can be adjusted easily, without the need to adjust the second hour hand, which displays the time of a different time zone.

For this purpose, after the blocking device has been actuated, the second hour tube can be blocked in one direction of rotation but can be freely rotated in the other direction by the first hour wheel, where preferably the second hour tube can be freely rotated in the clockwise direction by the first hour wheel and can be blocked in the counterclockwise direction by the blocking device.

The first axis of rotation and the second axis of rotation can be coaxial to each other.

If the time display of the two different time zones is to occur on scales which are not concentric to each other, the first axis of rotation and the second axis of rotation can also be parallel to each other, and the rotational movement of the first hour wheel can be transmitted to the second hour wheel by way of transmission wheels.

The second hour wheel can be easily blocked if the blocking device is provided with a pawl, which blocks in one direction of rotation and which can drop into a gap between two teeth of the second hour wheel, into a gap between two teeth of a wheel permanently mounted on the third hour tube, or into gap between two teeth of a wheel of a first gear train, which is connected to the second hour wheel.

For this purpose, the pawl can be free to swing around a pivot axis, and it can be actuated by a transmission lever of the blocking device. This lever can pivot around a lever axis and thus moves the pawl in the release direction against the force of a spring out of engagement with the second hour wheel or the other wheel.

So that this actuation can take place easily, the transmission lever is preferably pivoted by a manually actuatable push-piece mechanism.

In addition to the second time display, it is also possible for a time zone ring, which is provided with a circumferential toothed rim, to be adjusted in preferably twenty-four time zone steps by a manually actuatable adjusting mechanism so that it can display the time zone assigned to the second time display.

The number of different parts and the space they occupy can both be reduced by designing the adjusting mechanism as a manually actuatable push-piece mechanism.

The adjusting mechanism can have a pivotably driven catch, by which an adjusting wheel engaging in the toothed rim of the time zone ring can be rotated, where the time zone ring can be adjusted by one time zone step per pivot stroke of the catch.

For this purpose, the toothed rim of the time zone ring preferably has 192 teeth, and the adjusting wheel preferably has 32 teeth, where the adjusting wheel can be rotated by the catch by 8 teeth per stroke of the catch.

So that the adjusting wheel can be driven easily, the adjusting wheel can be permanently connected coaxially to a four-arm star wheel, which can be rotated by the catch, each stroke of the catch turning the star wheel 90°.

So that the catch does not have to move the four-arm star wheel completely into its new position and can at the same time hold the four-arm star wheel exactly in its new position, a latch, which determines the rest position of the four-arm star wheel and engages in a gap between two arms of the four-arm star wheel, can be spring-loaded.

So that it is possible to adjust the second hour hand at the same time that the time zone ring is adjusted, it is advantageous for a time zone pinion to engage in the toothed rim of the time zone ring. Thus, when driven by the toothed rim by one time zone step, the pinion can rotate a time zone driver by way of a coupling. The time zone driver is connected either directly or by way of a time zone drive train to the second hour wheel and adjusts this wheel by one hour.

A single component thus performs two different functions when the teeth of the time zone driver engage with the teeth of the wheel of the gear train.

So that, when the first hour hand makes one complete revolution every 12 hours, it is possible to tell whether the time being indicated is a daytime hour or a nighttime hour, a first day/night wheel making one revolution every 24 hours can be rotated by the first hour wheel; this first day/night wheel can rotate a first indicator symbol, especially a first day/night hand, by means of which the daytime hours and the nighttime hours can be indicated on a day/night scale, where the first day/night wheel can be rotated by the first hour wheel, acting by way of a second gear train.

For the same reason, the second hour wheel can cause a second day/night wheel to make one revolution every 24 hours; this second day/night wheel can rotate a second indicator symbol, especially a second day/night hand, by means of which the daytime hours and the nighttime hours can be indicated on a second day/night scale. Here, too, the second hour wheel, acting by way of the first gear train, can rotate the second day/night wheel.

The wheel of the first gear train can also serve as the second day/night wheel and thus serve multiple functions.

An exemplary embodiment of the invention is illustrated in the drawing and will be described in greater detail in the following.

DETAILED DESCRIPTION OF THE PRESENTLY PREFERRED EMBODIMENTS

Figure 1:
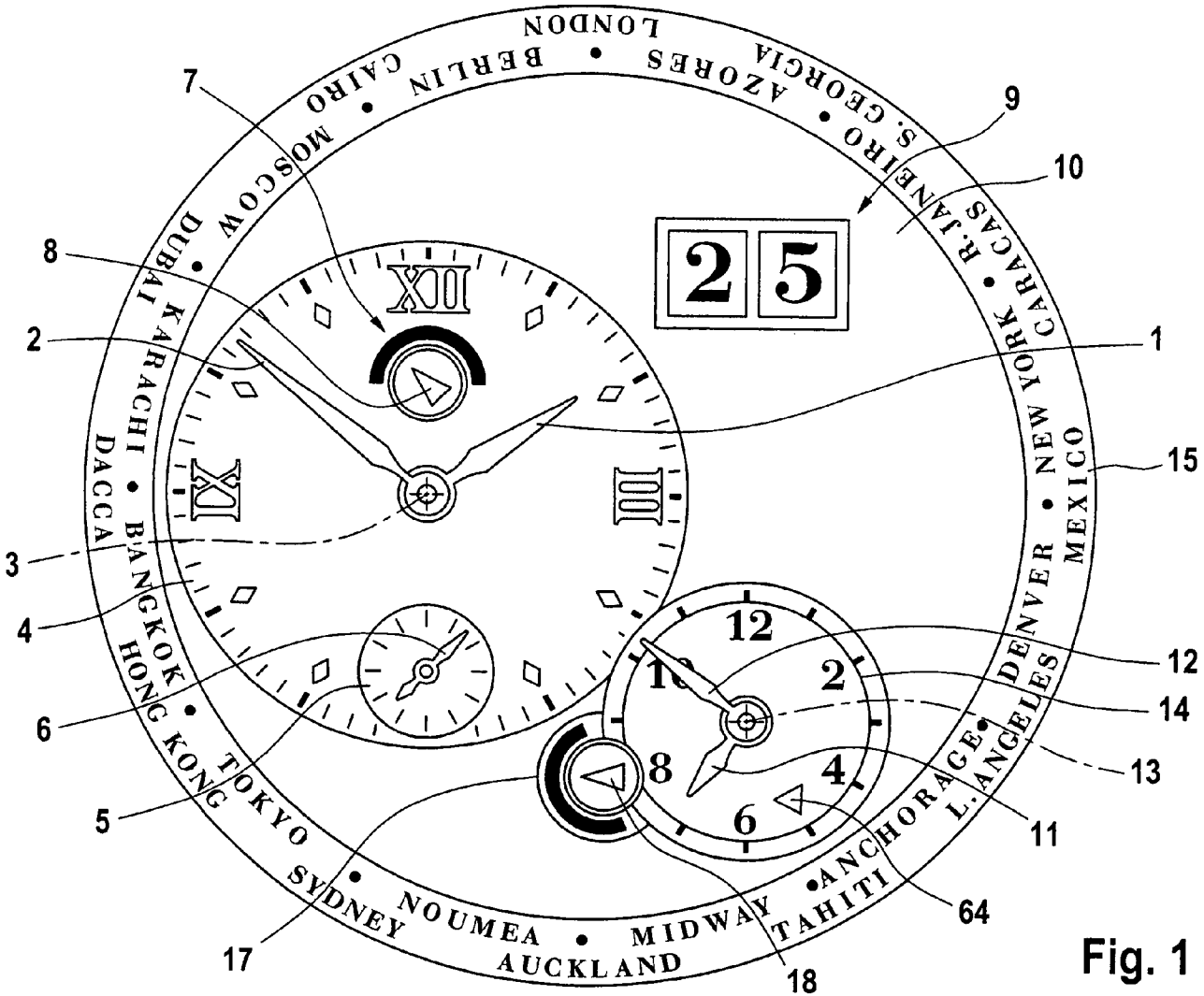
FIG. 1 shows a view of the dial of a watch with a time zone ring.
Figure 2:
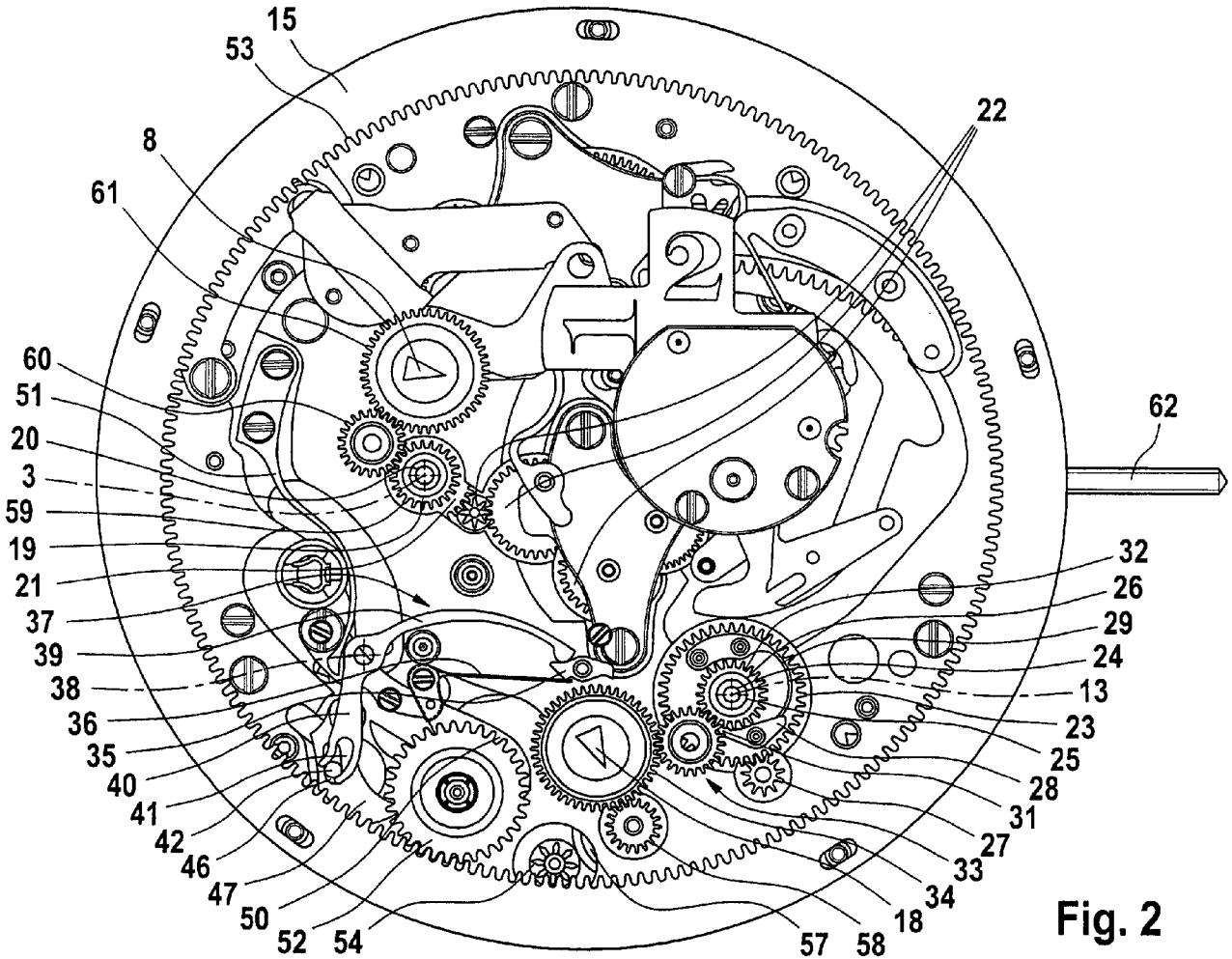
FIG. 2 shows a plan view of the hand-driving and adjusting mechanism of the watch according to Figure.

The circular dial 10 shown in FIG. 1 has a first hour hand 1 and a first minute hand 2, which can be driven by a watch movement (not shown) around a first hand axis 3 so that their tips pass over a first circular scale 4 in the center-left area of the dial 10.

In the 6-o'clock position of the first circular scale 4, a small second scale 5 is provided, over which a second hand 6 passes.

In the 12-o'clock position of the first circular scale 4, there is a circular first day/night scale 7, around which a rotating, pointer-like first indicator symbol moves.

In the upper right area of the dial 10 there is a double window 9 for indicating the date.

In the lower right area of the dial 10 there is a second hour hand 11 and a second minute hand 12, which can be rotated around a second hand axis 13, so that their tips pass over a second circular scale 14.

On the left, next to the second circular scale 14 and projecting partially into it is a second day/night scale 17, around which a rotating, pointer-like second indicator symbol 18 moves.

The entire dial 10 is surrounded by a time zone ring 15, on which twenty-four time zones in the form of the names of cities representative of each time zone appear, distributed uniformly around the circumference.

The first hour hand 1 is seated on a first hour tube 19, which carries a first hour wheel 16. A first minute arbor 20, which carries the first minute hand 2 and to which a minute pinion 21 is supported concentrically, is mounted concentrically in the first hour tube 19.

The first hour wheel 16 is driven by the minute pinion 21, acting by way of a minute wheel pinion 66. The minute pinion is itself driven by the watch movement. This minute pinion, acting by way of the first minute arbor 20 and the transmission wheels 22, also drives a second minute arbor 24, which carries the second minute hand 12.

The second minute arbor 24 is mounted concentrically in a second hour tube 25, which carries a second hour wheel 23 and to which a coaxial third hour tube 26 is connected by way of a spring-loaded latching connection. This third hour tube carries the second hour hand 11. The second hour wheel 23 is driven by the second minute arbor 24, which acts by way of a minute wheel pinion 27.

The latching connection has a latching lever 28, which is mounted on the second hour wheel 23 with freedom to pivot around an axis parallel to the second hand axis 13. The latch 31 of the latching lever is engaged by a spring 29 in a gap between two teeth of a twelve-tooth gear wheel 30 permanently mounted on the third hour tube 26.

In opposition to the force of the spring 29, the latch 31 can move out of the gap in which it is currently engaged and engage in the adjacent gap of the gear wheel 30.

A wheel 32 with twenty-three teeth belonging to a gear train 33, furthermore, is permanently mounted on the third hour tube 26; the teeth of this gear wheel engage with the teeth of another wheel 34 of the gear train 33 designed with forty-six teeth. This additional wheel 34 also carries a disk with the second indicator symbol 18.

A pawl 35, which can pivot around a pivot axis parallel to the axis of rotation of the additional wheel 34, can engage in a gap between two teeth of the additional wheel 34 and latch there under the force of a spring 36, thus blocking the rotational movement of this additional wheel 34 in the counterclockwise direction. Rotation in the clockwise direction, however, continues to be possible.

A two-armed transmission lever 37, which is supported pivotably on a lever axis 38, can, with the free end of its first lever arm 39, actuate the pawl 35 and bring it out of engagement with the additional wheel 34 in opposition to the force of the spring 36.

Figure 3:
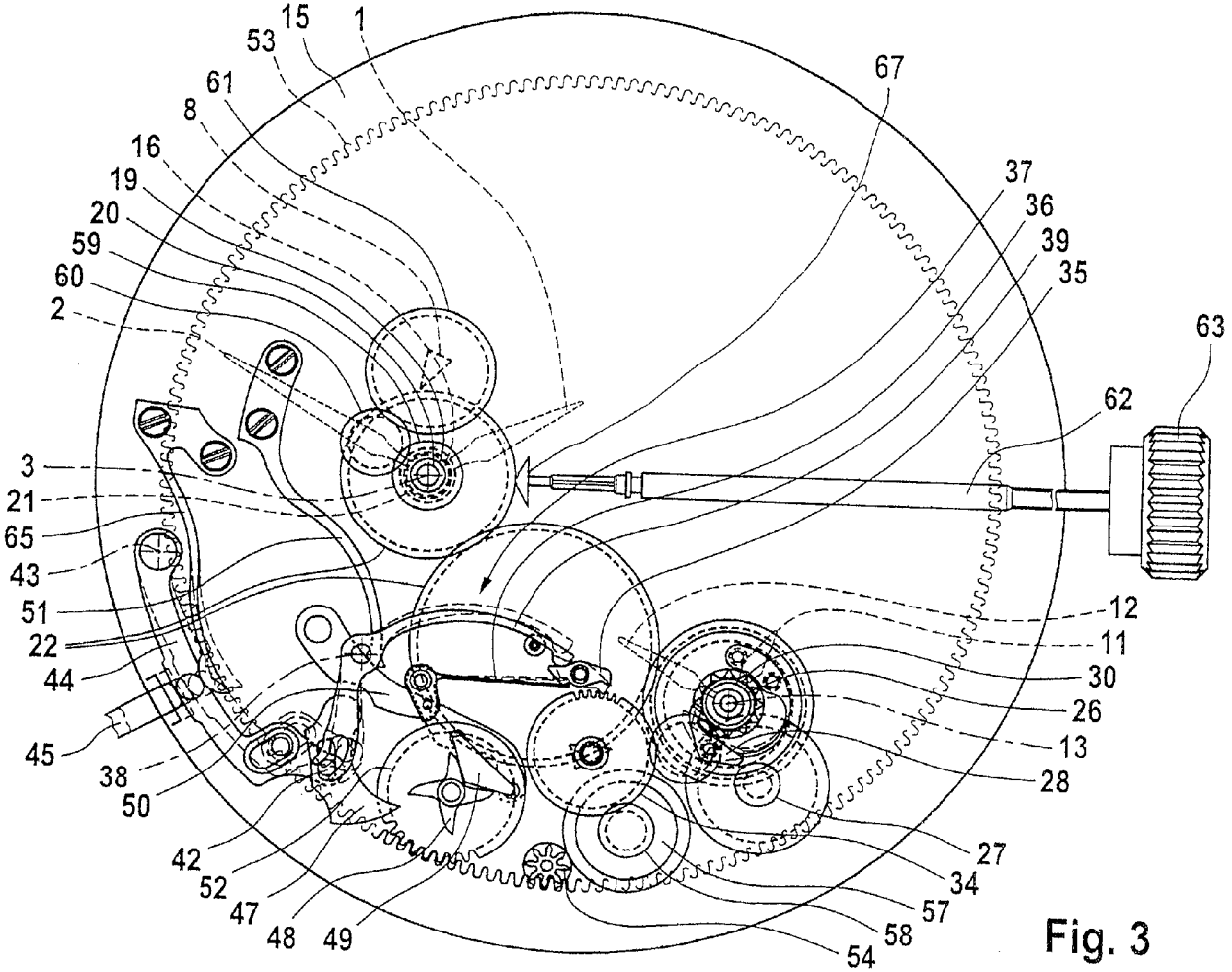
FIG. 3 shows another plan view of the hand-driving and adjusting mechanism of the watch according to FIG. 1.
Figure 4:
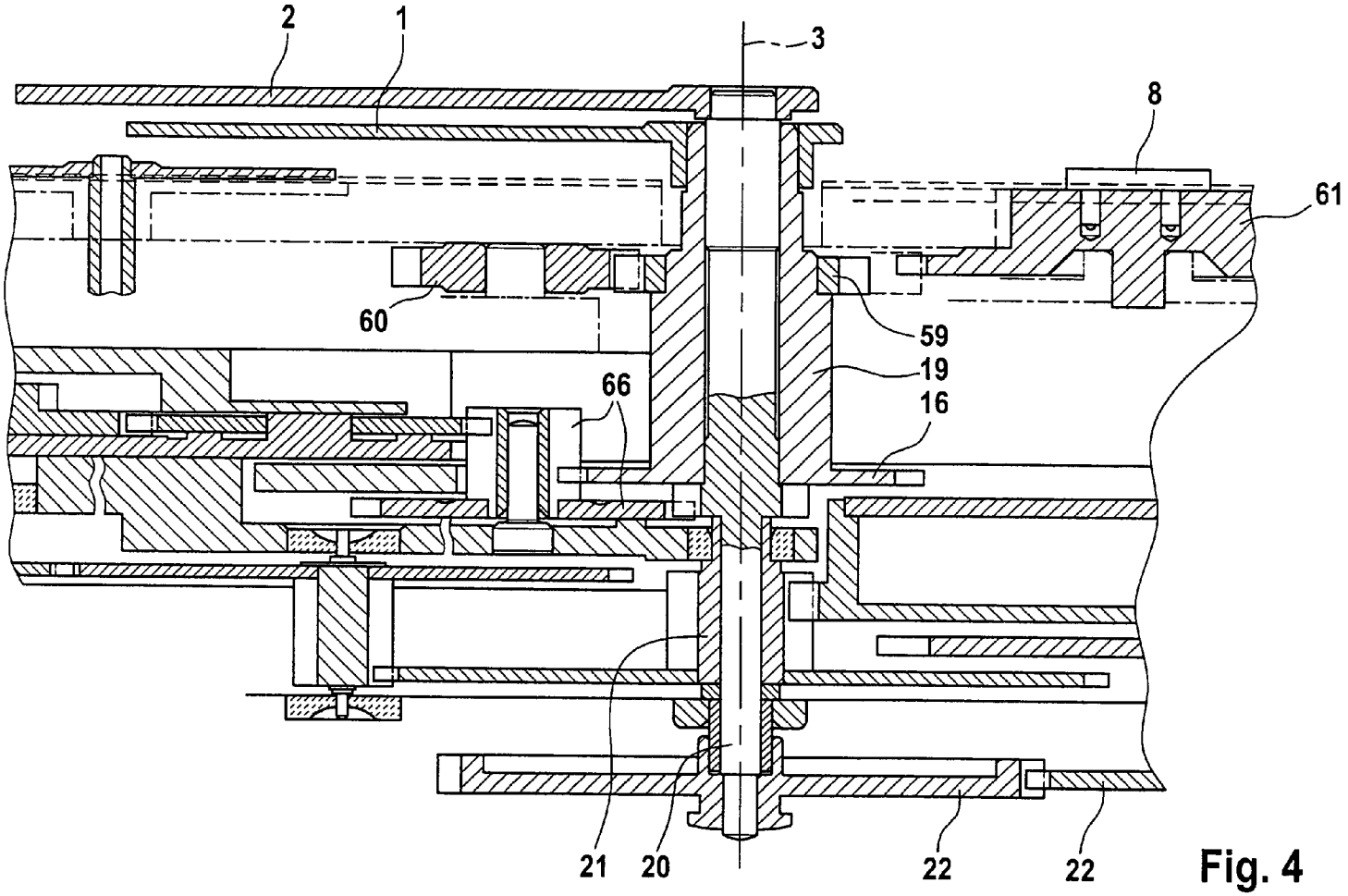
FIG. 4 shows a cross section through the hand-driving and adjusting mechanism according to FIG. 2 in the area of the first hour hand.
Figure 5:
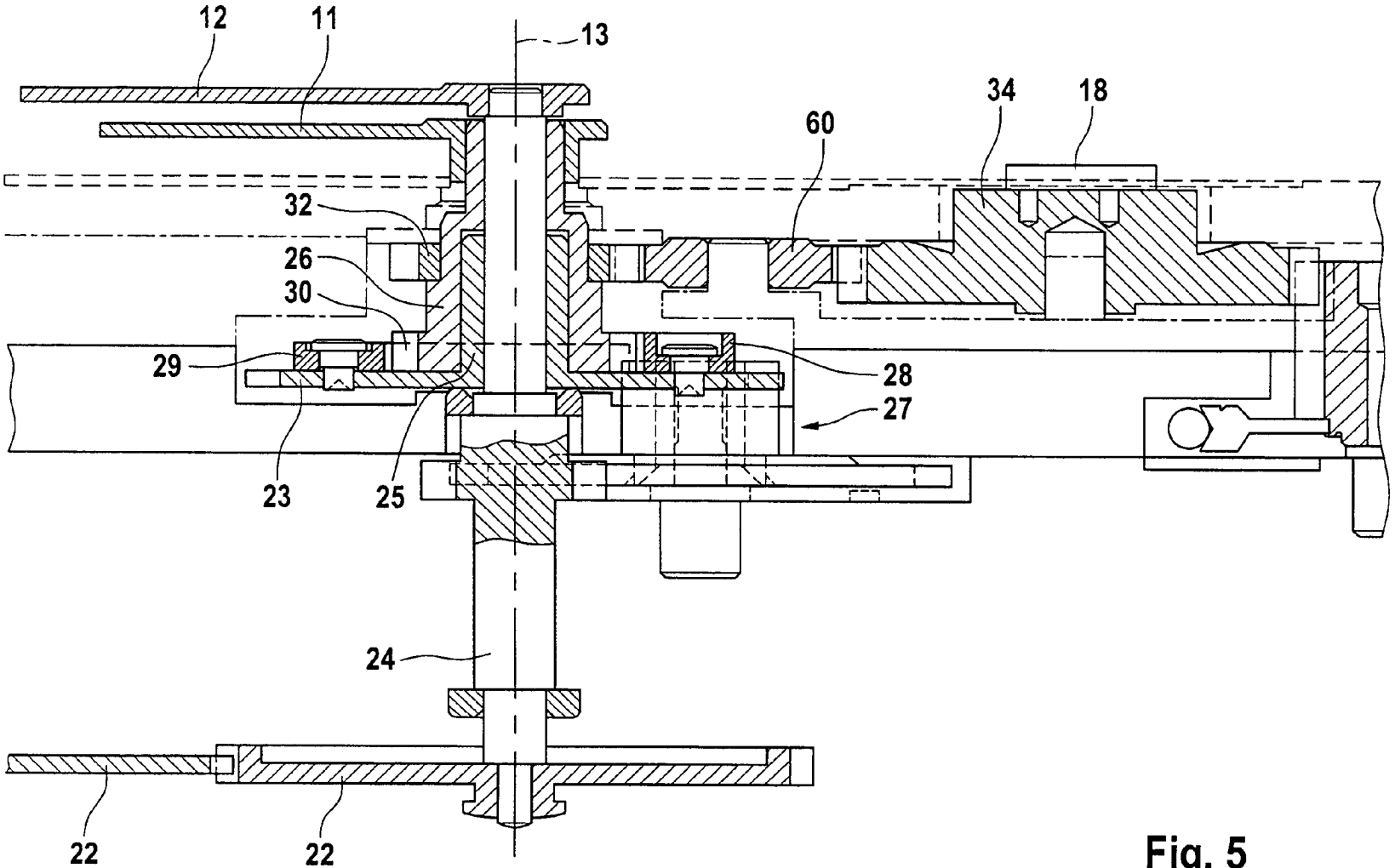
FIG. 5 shows a cross section through the hand-driving and adjusting mechanism according to FIG. 2 in the area of the second hour hand.

At the free end of the second lever arm 40, there is a slot-like connecting link 41, into which an adjusting pin 42 projects. This pin is mounted on a correcting lever 44, which pivots around a correcting lever axis 43. The correcting lever 44 can be moved by a manually actuatable push-piece 45 against the force of a correcting lever spring 65 out of a normal position, as illustrated in FIG. 3, into an actuation position. As a result, the correcting lever 44 and the transmission lever 37 are pivoted, so that the pawl 35 is released and under the action of the spring 36 latches in a gap between two teeth of the other wheel 34, thus blocking its rotation in the counterclockwise direction.

Upon termination of the manual actuation of the push-piece 45, the pawl 35 is moved back again out of engagement with the additional wheel 34.

The adjusting pin 42 continues to engage in a slot 46 in a catch 47, which is free to pivot around an axis.

Through actuation of the push-piece 45, therefore, the catch 47 is also pivoted, moving from a non-engaged position to an engaged and adjusting position with a rotatably supported four-arm star wheel 48. The four-arm star wheel 48 is rotated by the catch 47 so far in the clockwise direction that a latch 49, spring-loaded into engagement in a gap between two arms of the four-arm star disk 48, is moved out of this gap and arrives in the area of the adjacent gap. As a result of the spring-loaded latching in this adjacent gap, the four-arm star wheel 48 is advanced by a full 90° and is held in this position.

The latch 49 is mounted on the end of a pivotably supported latching lever 50, which is actuated in the latching direction by a spring 51.

Connected coaxially to the four-arm star wheel 48 is an adjusting wheel 52 with thirty-two teeth, which engage with the teeth of a toothed rim 53 of the time zone ring 15. The time zone ring 15 is rotatably supported, and one hundred ninety-two teeth of its toothed rim 53 face radially inward.

As a result of the rotation of the four-arm star wheel 48 by 90°, the toothed rim 53 is shifted by the adjusting wheel 52 by a distance of eight teeth, which means that the time zone ring 15 is shifted by one time zone.

The teeth of a rotatably supported time zone pinion 54 also engage in the toothed ring 53; this pinion, when driven by the toothed rim 53, rotates a connecting wheel 57, permanently connected to the time zone wheel pinion 58.

When driven by the watch movement, the time zone pinion 54 and the time zone wheel pinion 58 are disconnected from each other.

The time zone wheel pinion 58 also engages with the additional wheel 34, so that, when the catch 47 executes a stroke under the action of the push-piece 45, this additional wheel is turned by one time zone step in the clockwise direction and thus rotates without interference from the pawl 35. This movement is transmitted from the additional wheel 34 and the gear train 33 to the wheel 32, and the third hour tube 26 is rotated by one time zone step. Thus the latch 31 is moved out of the gap between two teeth of the gear wheel 30 and latches now in an adjacent gap. In addition to the first hour wheel 16, a wheel 59 with twenty-three teeth is also permanently mounted on the first hour tube 19; this wheel, acting by way of an intermediate wheel 60 with twenty-three teeth, drives a day/night wheel 61 with forty-six teeth, which carries a disk with the first indicator symbol 8.

On their associated day/night scales 7 and 17, the indicator symbols 8 and 18 point at either the day or the night area, the two areas being different in appearance.

The watch has an adjusting stem 62, which carries a crown 63 on its outward-projecting end and a drive wheel 67 on the inward-projecting end.

The adjusting stem 62 can be shifted axially to assume either one of two different positions. In the radially inward-shifted position, the stem serves as a wind-up stem for winding up the watch.

In the radially outward-shifted position of the adjusting stem 62, the drive wheel 67 engages in the first minute arbor 20. Thus, by rotation of the crown 63 and thus of the adjusting stem 62, all of the hands 1, 2, 11, 12 and indicator symbols 8 and 18 can be moved simultaneously forward or back Because the transmission wheels 22 are permanently engaged, the first minute hand 2 and the second minute hand 12 are always driven synchronously even when the hands are being adjusted.

The second hour hand 11, however, can be advanced in the clockwise direction through actuation of the push-piece 45 in one-hour steps and thus in time-zone steps, where simultaneously the time zone ring 15 is also moved forward in time-zone steps. An index 64 located inside the second circular scale 14 points to the selected time zone, to which the second hour hand 11 is assigned. The second indicator symbol 18 points to the second day/night scale 17, indicating whether it is day or night.

When the second hour hand 11 is adjusted to a different time zone in this way, the first hour hand 1 remains in its original position.

If the first hour hand 1 is to be adjusted to a certain time zone, the push-piece 45 is pushed, and the time zone ring 15 is adjusted until it has reached the desired position with respect to the index 64. When this position is reached, the push-piece 45 is kept pushed down, the crown 63 is pulled outward, and the hands are rotated in the clockwise direction to adjust them until the first hour hand 1 agrees with the second hour hand 11 and the first indicator symbol 8 agrees with the second indicator symbol 18. During this process, the two minute hands 2 and 22, the first hour hand 1, and the first indicator symbol 8 rotate. The second hour hand 11 and the second indicator symbol 18, however, stay still.

When the push-piece 45 is now released, the hour hand 11 and the indicator symbol 18 are both driven again when the crown 43 is turned.

What is claimed is:

1. A watch comprising:

a first hour wheel which carries a first hour hand and can be rotated about a first axis of rotation by a drive;

a second hour wheel which can rotate a second hour hand and can be rotated around a second axis of rotation by the first hour wheel, said second hour wheel being connected to said first hour wheel by a spring-loaded latching mechanism;

a manually rotatable adjusting stem by means of which the hour wheels can be adjusted jointly or individually, said adjusting stem carrying a drive wheel which can adjust the first hour wheel;

a manually actuatable blocking device which can block one of the second hour wheel and a third hour tube carrying the second hour hand;

a time zone ring having a circumferential toothed rim; and a manually actuatable adjusting mechanism which can adjust the time zone ring in twenty-four steps; and a second hour tube carrying the second hour wheel, said second hour tube being blocked in one direction of rotation but being freely rotatable in an opposite direction when the blocking device is actuated.

2. The watch of claim 1 wherein the second hour wheel can be freely rotated by the first hour wheel in a clockwise direction but can be blocked by the blocking device in a counter-clockwise direction.

3. The watch of claim 1 wherein the first axis of rotation and the second axis of rotation are coaxial to each other.

4. The watch of claim 1 wherein the first axis of rotation and the second axis of rotation are parallel to each other, the watch further comprising transmission wheels which can transmit rotational movement of the first hour wheel to the second hour wheel.

5. The watch of claim 1 wherein the blocking device has a pawl, which blocks in one rotational direction, this pawl being engageable in a gap between two teeth of one of a wheel fixed to the third hour tube and a wheel of a first gear train connected to the second hour wheel.

6. The watch of claim 5 wherein the blocking device further comprises a transmission lever which is pivotable about a pivot axis to pivot the pawl against the force of a spring in the unlatching direction out of said one of said wheels.

7. The watch of claim 6 further comprising a manually actuatable push-piece mechanism which can pivot the transmission lever.

8. The watch of claim 1 wherein the manually actuatable adjusting mechanism is a manually actuatable push-piece mechanism.

9. The watch of claim 1 wherein the adjusting mechanism has a pivotably drivable catch, by which an adjusting wheel engaging in the circumferential toothed rim can be turned.

10. The watch of claim 9 wherein the time zone ring can be adjusted by one time zone step per pivot stroke of the catch.

11. The watch of claim 10 wherein the circumferential toothed rim has 192 teeth, the adjusting wheel has 32 teeth, and the adjusting wheel can be rotated by the catch by 8 teeth per stroke of the catch.

12. The watch of claim 9 further comprising a four-armed star wheel permanently connected coaxially to the adjusting wheel, wherein the star wheel, which can be rotated by the catch by 90° per stroke of the catch.

13. The watch of claim 12 further comprising a spring-loaded latch which determines the rest position of the four-armed star wheel by engaging in a gap between two arms of the four-armed star wheel.

14. The watch of claim 1 further comprising:

a time zone pinion which engages in the circumferential toothed rim of the time zone ring; and a time zone wheel pinion which is rotated by the time zone pinion when the time zone pinion is driven by the circumferential toothed rim by one time zone step wherein the time zone wheel pinion is connected to the second hour wheel and thus adjusts it by one hour.

15. The watch of claim 14 wherein the time zone wheel pinion has teeth which engage with teeth of a wheel of a first gear train connected to the second hour wheel, and wherein the manually actuatable adjusting mechanism simultaneously adjusts the time zone ring in time zone steps and the second hour wheel in one-hour steps that correspond to the time zone steps, while the first hour hand remains in a current position.

16. The watch of claim 1 further comprising:

a first day/night wheel which can be rotated by the first hour wheel at a rate of one revolution per 24 hours; and a first day/night indicator which can be rotated by the first day/night wheel to show whether it is daytime or nighttime on a first day/night scale.

17. The watch of claim 16 wherein the first day/night wheel can be rotated by the first hour wheel by way of a second gear train.

18. The watch of claim 1 further comprising:

a second day/night wheel which can be rotated by the second hour wheel at a rate of one revolution per 24 hours; and a second day/night indicator which can be rotated by the second day/night wheel to show whether it is daytime or nighttime on a second day/night scale.

19. The watch of claim 18 wherein the second day/night wheel can be rotated by the second hour wheel by way of the first gear train.

20. The watch of claim 1 wherein the first and second hour hands are disposed on a circular dial and said time zone ring surrounds said circular dial.

* * * * *